United States Patent [19]

Obadia

[11] Patent Number: 4,457,439

[45] Date of Patent: Jul. 3, 1984

[54] TAMPERPROOF CLOSURE MADE OF PLASTICS MATERIAL

[75] Inventor: Jacques Obadia, Paris, France

[73] Assignee: Rical S.A., Longvic, France

[21] Appl. No.: 471,497

[22] Filed: Mar. 2, 1983

[30] Foreign Application Priority Data

Mar. 9, 1982 [FR] France ..... 82 03968

[51] Int. Cl.[3] ..... B65D 41/48

[52] U.S. Cl. ..... 215/256

[58] Field of Search ..... 215/256, 254, 255

[56] References Cited

U.S. PATENT DOCUMENTS 2,069,410 2/1937 Hochstadter ..... 215/254

4,244,479 1/1981 Smalley ..... 215/254 X

FOREIGN PATENT DOCUMENTS 256816 3/1963 Australia ..... 215/256

1146488 11/1957 France .

1395665 3/1965 France .

1489177 7/1967 France .

1514087 1/1968 France ..... 215/255

2414006 3/1979 France .

*Primary Examiner*—Donald F. Norton

*Attorney, Agent, or Firm*—Owen, Wickersham & Erickson

[57] ABSTRACT

A tamperproof closure has a raised top and a depending tearable guarantee strip. The strip has a tongue extending upward to the level of the upper edge of the top.

8 Claims, 4 Drawing Figures

TAMPERPROOF CLOSURE MADE OF PLASTICS MATERIAL

This invention relates to a tamperproof or pilferproof closure for bottles comprising an external ring round their neck. This closure comprises a stopper of plastics material provided with a top designed to be applied against the end face of the neck and a sealing part projecting downwards from the said top and designed to be driven into the neck to engage with the inner surface of this neck. In addition the closure comprises tearable means which engage, before the bottle being closed is opened for the first time, with the ring to retain the stopper on the neck in a tamperproof manner.

In known closures of this type designed for so-called ring-type (biological finish) bottles, the stopper is retained on the bottle neck, before this bottle is first opened, by means of a metal cap crimped either behind the neck ring or, in the case of a grooved ring finish, into the groove in this finish. These known "composite" closures not only involve problems in fabrication and installation on the bottles, just because they consist of two sections of different materials and because of the need to crimp a metal cap, but they also have many drawbacks from the utilization standpoint. Thus tearing off the metal cap when first opening the bottle often gives rise to difficulties and may risk causing injury.

In order to make it easier to tear off the metal cap it has already been proposed to provide a tear strip joined to the stopper by a line of least resistance and comprising a pull tab. However, this pull tab projects from the closure and thus makes it impossible to install the closures at a high rate since it is necessary to orient the closures so as to present them in a specific angular position, just because of this projecting tab. Furthermore, this projecting pull tab may lead to inadvertent opening, or at least inadvertent partial tearing of the metal caps when handling closed bottles, which again leads to the risk of being injured.

Closures made in one piece from plastics materials have already been proposed with a wide range of tamperproof means, but these tamperproof means always comprise projecting parts which require orientation on installation, thus making high-rate installation impossible; they are liable to catch and to open inadvertently and involve using complicated moulds which increase their cost price.

The same problems arise for closures designed to work, not directly in conjunction with a bottle neck, but with a separately made pouring element fitted to a bottle and having an outer bead near to the pouring spout thereof.

The object of this invention is a closure made of plastics material which, though being made in one piece in a simple mould, and therefore being low in cost, is perfectly tamperproof, eliminates the risk of inadvertent opening, for example when handling the bottles, and is simple and easy to use both when first opening the bottle and when subsequently restopping it and reopening it.

The closure according to the invention consists of a plastics material stopper provided with a top and a sealing part projecting from the said top; the upper outer edge of the said top is raised above the part of the top designed to be pressed against the end face of the neck. This closure also comprises tear means made in one piece with the stopper and consisting of an annular guarantee strip prolonging the external side wall of the stopper top downwards. This guarantee strip has an internal bead hooking onto the said bottle neck ring and comprises a pull tongue extending up to the level of the upper outer edge of the top forming a segment of the outer side wall of the top. The guarantee strip is joined to the lower outer edge of the stopper top by a line of least resistance. On its side the guarantee strip tongue is joined to the outer side wall of the top by two lines of least resistance, one of which is continued downwards across the guarantee strip.

The whole closure has an external cylindrical or tapered configuration, conforming to the bottle finish, is perfectly smooth and has no part protruding sideways, upwards or downwards which could catch during bottle handling and no bearing surface for tampering with the closure, i.e. for forcing it off without tearing the guarantee strip. It is thus possible to fit the closures at high rates without preliminary orientation.

The guarantee strip tongue preferably has a pull tab on its free end directed to the inside. This makes it even easier to tear off the guarantee strip since this tab gives the user's finger a better grip.

In order to make moulding easier it is advantageous for the tongue pull tab to branch off below the free end of the tongue, i.e. below the upper edge of the stopper top and to extend obliquely inside and upwards.

In order to simplify tearing the guarantee strip is advantageous for the line of least resistance which joins the tongue to the side wall of the stopper top and is continued across the guarantee strip to comprise a roughly vertical upper section followed by a lower section sloping in the direction of circular tearing of the guarantee strip.

It is advantageous, in order to make the method of tearing the guarantee strip perfectly clear to the user, for the stopper top to have an outer upper part raised above a lower inside part, except at the location of the said tongue where this lower part extends as far as the outer side wall of the stopper, here formed by the tongue. The stopper top thus has an asymmetrical cavity or recess which suggests to the user the way to insert the finger to grip the tongue pull tab, which tab projects into the said recess or cavity.

It is advantageous for the said raised outer part of the stopper top to have an upturned U shape stiffened by roughly vertical axial ribs, the under edges of which bear against the upper face of the bottle neck. This deep ribbed form of the stopper top provides the stopper with good stiffness, eases opening and reclosing operations and offers good strength and even absorbs the mechanical stresses which occur during storage and transport of the closed bottles.

In order to further improve the grip on the stopper during reclosing and opening operations, it is advantageous for the outer side wall of the stopper top to be extended downwards below the bearing face of the stopper top bearing on the end face of the bottle neck.

In order to clearly indicate any efforts to tamper with the closure, aimed at removing the closure by means of a tool raising it from the bottom, it is advantageous for the guarantee strip to comprise several vertical lines of least resistance extending from the said inside bead down to the bottom edge of the strip.

Below we shall describe in greater detail an illustrative embodiment of the invention which is not restrictive, reference being made to the appended drawings in which.

Figure 1:
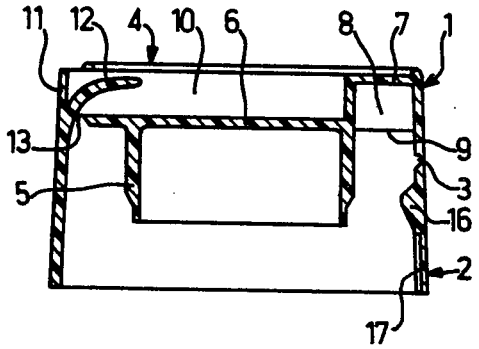
FIG. 1 is a section view of a closure according to the invention, taken in an axial plane passing through the guarantee strip tear tongue.
Figure 2:
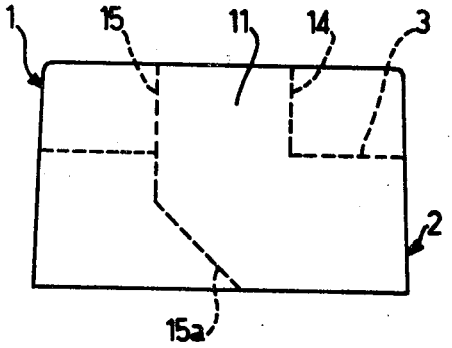
FIG. 2 is a side elevation view of the closure in FIG. 1, taken facing the tear tongue.
Figure 3:
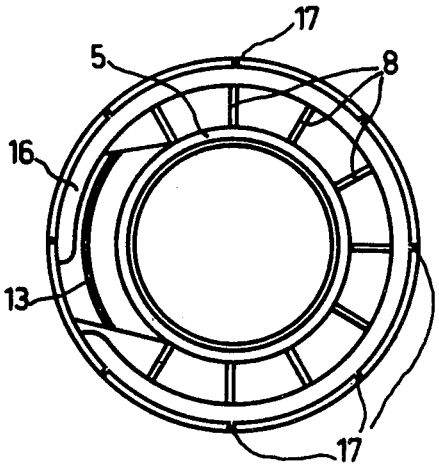
FIG. 3 is a bottom view of the closure in FIG. 1.

The closure illustrated in the drawings, designed for a grooved ring finish bottle, comprises a stopper 1 and a circumferential guarantee strip 2 joined to the lower outer edge of the stopper 1 by a line 3 of least resistance.

The stopper 1 comprises, in a manner known per se, a top 4 designed to be applied onto the end face of the neck of the bottle being closed, and a sealing part 5 projecting downwards from the said top. The sealing part 5 which, in the illustrated example, comes in the shape of a roughly cylindrical skirt, is designed to be driven by force into the neck so as to engage against the inside surface of the neck.

Figure 4:
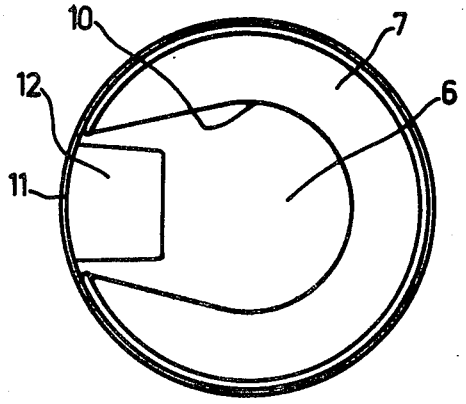
FIG. 4 is a top view of the closure in FIG. 1.

The stopper 1 top 4, instead of being flat and thin, has a central part 6 surrounded by a raised outer part 7, except round a relatively small angular segment, as is shown in FIG. 4 in particular. The raised part 7 has an upturned U profile and comprises radial vertical ribs 8 on the inside, the bottom edges 9 of which bound that part of the stopper 1 bearing against the end face of the bottle neck. The raised outer part 7 and the lower central part 6 of the stopper 1 top 4 therefore bounds a sort of cavity or recess 10 which is asymmetrically shaped and has a function which will become clear later.

The guarantee strip 2 which is located in the continuation of the outer side wall of the stopper 1, is continued upwards by a tongue 11 at the position where the raised outer part 7 of the top 4 of the stopper 1 is discontinued. The tongue 11 here acts as the outer side wall of the stopper 1, i.e. it here completes the outer side wall of the stopper 1, formed over the rest of the periphery by the raised part 7 of the top 4 of the stopper 1.

The tongue 11 comprises, at a distance below its upper end, a pull tab 12 which slopes or curves upwards and inwards so as to extend into the cavity or recess 10 without, however, projecting above the raised upper part of the top 4.

The tongue 11 is joined to the lower central part 6 of the top 4 by a line of least resistance 13 and, on each side, to the outer wall of the raised part 7 of the top 4 by a line 14, 15 of least resistance. The line 14 continues downwards as far as the line of least resistance 3 joining the ring 2 to the lower edge of the stopper 1. The other line 15 continues roughly vertically downwards to below line 3, i.e. inside the strip 2, and is then continued to the bottom edge of the strip 2 by a line of least resistance 15*a* sloping in the direction of the continuation of the other lateral line 14.

The guarantee strip 2 has a bead 16 on the inside serving to hook the closure into the groove of the grooved ring finish of the bottle. This bead 16 is broken at the location of the line of least resistance 15 so as not to hinder the strip 2 from being torn along this line.

Finally the strip 2 has several lines 17 of least resistance spread round the periphery; these lines extend from the bead 16 down to the bottom edge of the strip 2.

The complete closure, moulded in one piece from plastics material, has an outer shape of revolution which is smooth with no part projecting either laterally or upwards or downwards. This closure can therefore be fitted in any angular position on a bottle without any preliminary orientation, thus allowing very high installation rates to be achieved.

When the bottle is first opened the finger is inserted into the cavity or recess 10, in the direction suggested by the asymmetrical shape of this recess 6, so as to take hold of the tab 12 of the tongue 11 and pull the tongue 11 outwards. This causes horizontal line 13 to tear and lines 14 and 15 to tear as far as line 3. The tearing then continues along line 15 until it reaches the sloping line 15*a*, which automatically deflects the tongue 11 in the direction of the slope of line 15*a*. The user is thus naturally made to continue the tearing movement in the direction imposed, i.e. to make a circular tear throughout the length of line 3. At the end of this circular tearing the guarantee strip 2 is completely separated from the stopper 1 which remains on the bottle neck.

Once the guarantee strip has been removed in this way, the stopper 1 is released and can be removed and put back as required. The raised shape of the top 4 of the stopper 1 makes it easier to grip the stopper during these opening and reclosing operations.

It should again be pointed out here that, in the example shown (see FIG. 1), the outer side wall of the stopper 1 top 4 is continued downwards below the bearing surface of the stopper 1 bearing against the end face of the neck, this surface being bound by the upper edges 9 of the ribs 8.

The smooth outer surface of the closure according to the invention means that there is no difficulty in applying ornamentation or, for example, an excise or fiscal stamp or seal.

Although the closure as described above and shown in the drawings is designed for a bottle with a grooved ring finish in which the inside bead 16 of the guarantee strip 2 hooks into the intermediate groove in the ring finish, the closure according to the invention can be fitted to all types of bottle rings without difficulty. For that purpose it suffices to provide the retaining bead 16 at the right height below the bearing surface 9 of the stopper 1 bearing against the end face of the neck so that the bead 16 hooks in behind a shoulder on the ring.

Furthermore, the closure can also be used on a bottle fitted with a separate fitted-on pouring unit, in which case the skirt 5 is pushed into the pouring spout and the inner bead 16 engages with an outer bead on the pouring unit.

It goes without saying that, without leaving the framework of this invention, it is possible to make numerous modifications and variants on the closure described and shown. Thus the sealing part 5 projecting from the top 4 of the stopper 1 could, for example, be shaped like a cup closed at the bottom and open at the top, instead of being in the form of a skirt or upturned cup opening at the bottom and closed at the top. The lines of least resistance 14 and 15 could also have different forms. The same is true for the pull tab 12 on the guarantee strip 2 tongue 11.

I claim:

1. A tamperproof closure for bottles comprising an external ring round their neck, this closure comprising a plastics material stopper provided with a top intended to be applied against the end face of the neck, said top having neck contact portions, an upper outer edge raised above the neck contact portions, a bottom outer edge, and an outer side wall, and a sealing part projecting downwards from the said top and designed to be pushed by force into the neck to engage against the inside surface of this neck, and tearable means for engaging, before the first opening of the bottle to be closed, with the said ring to retain the stopper on the neck in tamperproof fashion, the said tearable means comprising an annular guarantee strip made in one piece with the stopper, continuing the outer side wall of the top of the stopper downwards, having an inner bead hooking onto the said neck ring and comprising a tongue extending upwards up to the level of the upper outer edge of the top forming a segment of the outer side wall of the top, the said strip being joined to the bottom outer edge of the top of the stopper by a tear line and the said tongue being joined to the outer side wall of the top of the stopper by two tear lines one of which is continued downwards across the guarantee strip.

2. The closure according to claim 1, characterized in that the said tongue has, at one end, a pull tab oriented towards the inside.

3. The closure according to claim 2, characterized in that the said pull tab originates below said one end of the said tongue and extends obliquely inwards, and upwards, without going above the upper outer edge of the top of the stopper.

4. The closure according to claim 1, characterized in that the said tear line continued downwards across the guarantee strip comprises a roughly vertical upper section and a lower section sloping in the direction along which the circular tearing of the guarantee band has to be carried out.

5. The closure according to claim 4, characterized in that the said top of the stopper has a raised outer upper part surrounding a lower central section except at the position of the said tongue, so as to bound an asymmetrically shaped recess.

6. The closure according to claim 5, characterized in that the said raised outer part of the top of the stopper has a U shape as viewed from above stiffened by axial vertical ribs the under edges of which form the neck contact portion of the top designed to bear against the end face of the bottle neck.

7. The closure according to claim 6 characterized in that the outer side wall of the top of the stopper is extended downwards below the neck contact portion of the top bearing against the end face of the bottle neck.

8. The closure according to claim 7 characterized in that the said strip possesses, several tear lines extending from the said bead down to the bottom edge of the strip and spaced around the periphery of the closure.

* * * * *